US006969070B2

(12) United States Patent
Reimert et al.

(10) Patent No.: US 6,969,070 B2
(45) Date of Patent: Nov. 29, 2005

(54) SPLIT CARRIER ANNULUS SEAL ASSEMBLY FOR WELLHEAD SYSTEMS

(75) Inventors: Larrey E. Reimert, Houston, TX (US); Lionel J. Milberger, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 95 days.

(21) Appl. No.: 10/411,543

(22) Filed: Apr. 10, 2003

(65) Prior Publication Data

US 2003/0193145 A1 Oct. 16, 2003

Related U.S. Application Data

(60) Provisional application No. 60/372,399, filed on Apr. 12, 2002.

(51) Int. Cl.[7] ..... E21B 33/00

(52) U.S. Cl. ..... 277/323; 277/339; 277/314; 166/196

(58) Field of Search ..... 277/336, 339, 277/340, 323, 314, 609, 616, 615; 166/339, 208, 212, 196

(56) References Cited

U.S. PATENT DOCUMENTS 2,715,441 A * 8/1955 Bouvier ..... 166/127
3,472,520 A * 10/1969 Burns ..... 277/339
4,719,971 A * 1/1988 Owens ..... 166/191
4,757,860 A * 7/1988 Reimert ..... 166/208
4,781,387 A * 11/1988 Braugh ..... 277/329
4,790,572 A * 12/1988 Slyker ..... 285/123.12
4,823,871 A * 4/1989 McEver et al. ..... 166/182
4,880,061 A * 11/1989 Ahlstone ..... 166/348
5,038,865 A * 8/1991 Taylor et al. ..... 166/387
5,076,356 A * 12/1991 Reimert ..... 166/115
5,330,002 A * 7/1994 Saunders ..... 166/208
5,511,620 A * 4/1996 Baugh et al. ..... 166/387
5,685,369 A * 11/1997 Ellis et al. ..... 166/195
6,176,310 B1 * 1/2001 Smith et al. ..... 166/89.1
6,203,020 B1 * 3/2001 Mireles et al. ..... 277/339
6,494,257 B2 * 12/2002 Bartlett et al. ..... 166/86.2

* cited by examiner

*Primary Examiner*—Alison K. Pickard
(74) *Attorney, Agent, or Firm*—Browning Bushman P.C.

(57) ABSTRACT

The seal assembly 10 seal between a subsea wellhead housing 12 and a casing hanger 16. A metal seal body 20 includes fingers 32 and 34 and one or more elastomeric seals 38. An upper seal body 64 may include threads for engagement with the metal seal body. According the method of the invention, an initial elastomeric seal is first formed, and fluid pressure is applied from above to set the high temperature metal seal.

66 Claims, 2 Drawing Sheets

SPLIT CARRIER ANNULUS SEAL ASSEMBLY FOR WELLHEAD SYSTEMS

RELATED CASE

This application claims priority from U.S. Ser. No. 60/372,399 filed on Apr. 12, 2002, and entitled "Downhole Radial Set Packer Element", hereby incorporated by reference.

FIELD OF THE INVENTION

The present invention relates to the wellhead system with an annulus seal assembly and, more particularly, relates to a spit carrier annulus seal assembly suitable for use between a subsea wellhead housing and a casing hanger.

BACKGROUND OF THE INVENTION

In a subsea wellhead system, an annulus seal assembly may seal the annulus between the wellhead housing and the OD of the casing hanger. This seal (or seal assembly) is conventionally run in with a running tool, which also runs and lands the casing hanger. The running tool may be manipulated so as to cause the seal to be set and then tested, typically from a pressure above to a pressure at or below the working pressure of the wellhead system.

Annulus seal assemblies have performed well in subsea wellhead systems at normal temperatures of 250 degrees F. or below. However, it has become desirable to have such seals perform at elevated temperature of 350 degrees F. or higher, i.e., during high temperature production operations. Such seals are difficult to design using normal elastomers for sealing integrity. Using an 'all-metal' design for the annulus seal assembly, the undesirable aspects of the elastomer are eliminated, such as thermal expansion properties, hydrostatic compression properties, high temperature degradation properties and degradation in the presence of drilling/production fluids. The all-metal properties are particularly needed during production operations (as compared to the drilling phase) where high temperatures might be present downhole for extended time periods.

The disadvantages of the prior art were overcome by the present invention, and an improved seal assembly for use in a subsea wellhead system is hereinafter disclosed.

SUMMARY OF THE INVENTION

The seal assembly of this invention may be used to seal with various oilfield equipment, such as a tubing hanger to a cylindrical bore of a subsea wellhead housing. The invention may also be used to seal between any two pieces equipment, one of which contains a taper and the other piece having a cylindrical inner or outer surface for sealing with the seal assembly.

The seal assembly may thus be used for sealing between an outer member and an inner member, with one of these members having a tapered surface for moving a seal assembly radially to a set position in response to axial movement of the seal assembly relative to the tapered surface. The seal assembly includes a metal seal body including one or more radially extending fingers, another body for selective engagement with the metal seal body, and a high temperature seal ring spaced between one of the metal fingers and the another body, such that the high temperature seal may be positioned axially between the metal body seal body and another body. In a preferred embodiment, the another body includes another radially extending finger, such that the seal assembly is supported axially between one of the metal fingers and the another finger.

According to the method of the invention, a seal is formed between an outer member and an inner member by providing the seal assembly having a metal seal body with one or radially extending fingers, providing another body for selective engagement with the metal seal body, and axially spacing a high temperature seal between the metal seal body and the another body. Thereafter, the seal assembly may be positioned between the outer member and the inner member, and a wedge moved relative to the seal assembly to radially move the seal assembly to a set position, such that the high temperature seal seals with one of the outer member and the inner member.

The high temperature seal ring may be formed from a group including one or more of tin, a tin alloy, a lead, a lead alloy, indium, indium alloy, cast iron, and a metal softer than a metal seal body. This "final" high temperature seal ring alternatively may be formed from a group including one or more of the PEEK plastic material, a Teflon plastic material, and a grafhoil graphite material.

It is a further feature of the invention that a low temperature seal ring may be positioned on one of the metal seal body and the another body. At least one of the low temperature seal rings may be formed from a rubber or elastomeric material which is relatively elastic, so as to initially form a seal which preferably pulls the final seal toward the set position. The low temperature seal ring accordingly may have an initial sealing diameter for sealing engagement before sealing engagement of the high temperature seal ring, with a low temperature seal ring having an elasticity significantly greater than that of the high temperature seal ring. The low temperature seal may be spaced between an upper, downwardly inclined metal finger and a lower upwardly inclined finger.

In a preferred embodiment, the inner member includes the taper on its outer diameter to form a wedge ring. One or more annular bumps may be provided on the seal body radially opposite the one or more metal fingers. At least one of the metal fingers may be a continuous circumferential metal ring having an end for sealingly engaging one of the outer member and the inner member. In another embodiment, a plurality of the metal fingers may each have a sealing end.

The outer member may be a subsea wellhead housing, with the tapered surface on the outer diameter of a tubular hanger forming the inner member. One or more of the metal fingers may include a soft tip in the form of a weld inlay for reliable sealing when in the set position.

According to the method of the invention, a low temperature seal may be initially set by applying a setdown weight to the seal assembly, closing a blowout preventor around a running string, and then pressurizing choke and kill lines to move the seal assembly to a set position. The low temperature seal may become disabled after setting the high temperature seal. In a subsea environment, the seal assembly may thus be run in a well on a run-in tool with a tubular hanger as the inner member.

These and further features and advantages of the present invention will become apparent from the following detailed description, wherein reference is made to the figures in the accompanying drawings.

DETAILED DESCRIPTION OF THE PREFERRED EMBODIMENTS

The seal assembly includes a two-piece seal body or carrier. This design allows a variety of lower temperature complete circular elastomeric seal elements to be easily installed on the seal body, thereby allowing an economical design of a complete seal assembly. This elastomeric seal may be used as a temporary puller seal used during installation, as explained below. A metallic seal element is installed between two axially spaced fingers or stops, each on one of the seal bodies. The seal body includes generally radially extending ribs or fingers for carrying the elastomeric seal element down hole and optionally aiding in metal-to-metal sealing. The two-piece seal body preferably includes a thread for screwing the two halves of the two-piece seal body together. Other securing techniques may be used, such as bolting the two pieces together. Threading of the two-piece seal bodies is preferred, however, since this low cost manufacturing technique easily allows for field replacement of a selected final seal ring, as explained below.

Figure 1:
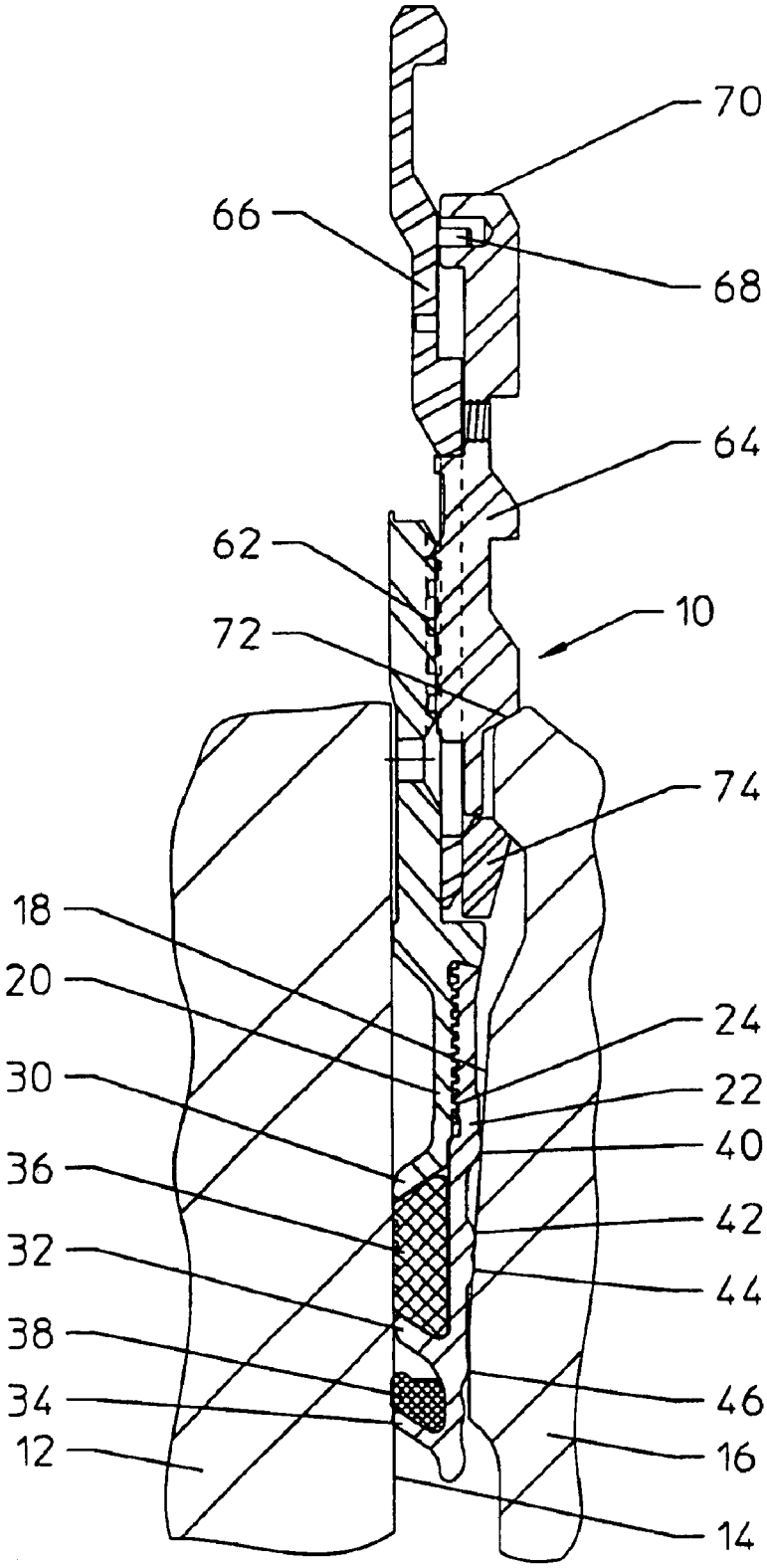
FIG. 1 illustrates a suitable seal assembly according to the present invention for sealing between a wellhead housing and a casing hanger.

FIG. 1 illustrates a seal assembly 10 for sealing with the interior surface 14 of wellhead housing 12 and with the exterior surface 18 of casing hanger 16. Seal assembly 10 includes an upper seal body or carrier 20 which comprises of metal piece including upper finger 30, and a second lower metal piece 22 which for this embodiment includes middle finger 32 and lower finger 34. A final, e.g., high temperature, seal 36 is shown between the finger 30, the sleeve-shaped lower body 22, and the finger 32, while an initial, e.g., low temperature, elastomeric puller seal 38 is positioned between the middle finger 32 and the lower finger 34. The seal assembly as shown in FIG. 1 includes fingers wherein finger ends sealingly engage wellhead housing 12, while seal assembly 50 as shown in FIG. 2 has fingers which are not intended for sealing engagement with the wellhead housing.

Figure 2:
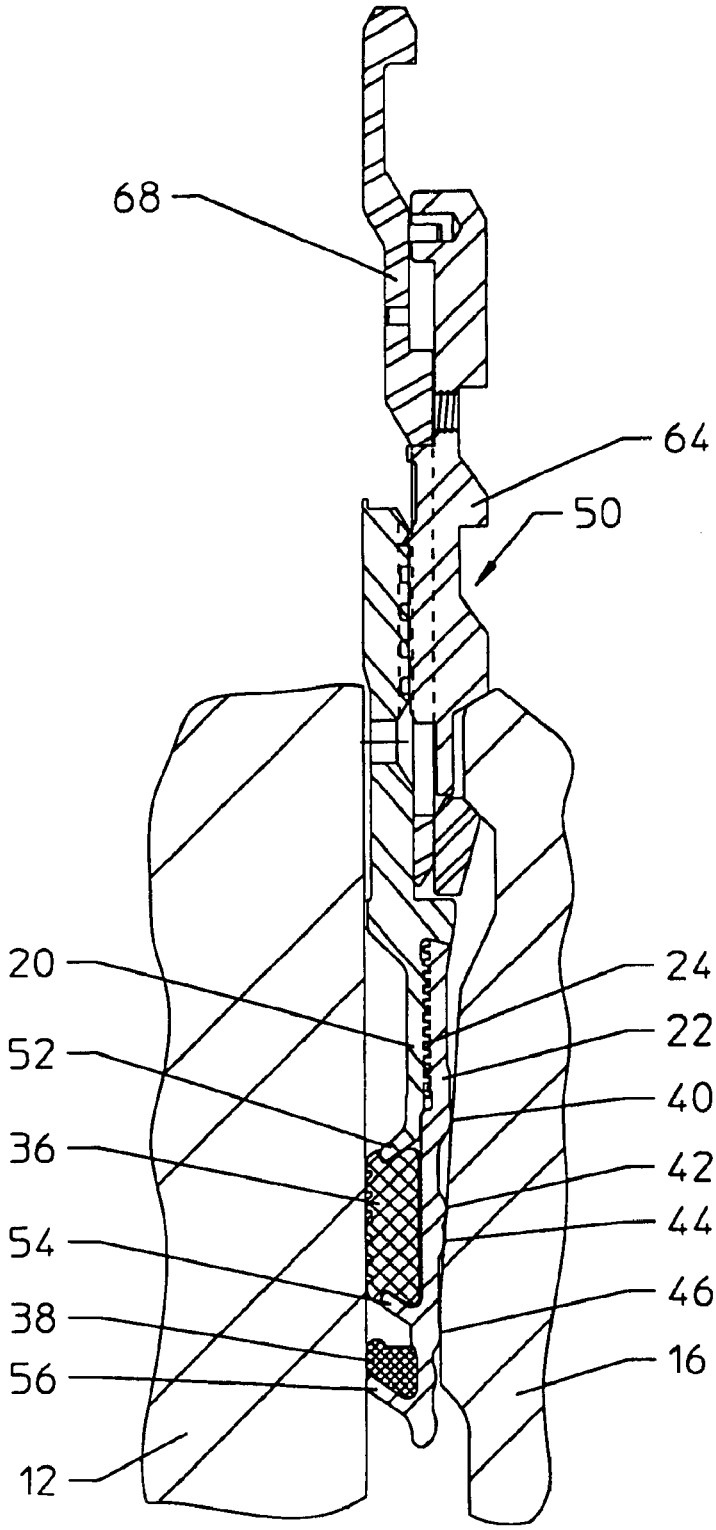
FIG. 2 depicts an alternate seal assembly according to the present invention.

FIGS. 1 and 2 illustrate that the first upper seal body 20 includes upper threads 62 for threaded engagement with upper seal body landing member 64. As shown in FIGS. 1 and 2, the wedge ring 66 has moved downward relative to the landing member 64, shearing the pin 68. A downward force applied to the seal assembly from a pulling tool or setting tool, to which fluid pressure may be applied from above to set the seal, may thus also act on the upper surface 70 of the landing member 64, transmitting the downward force to the load shoulder 72 on the casing hanger 16. Lock ring 74, which preferably is in the form of a C-ring, may be used to axially interconnect the seal assembly to the casing hanger once the seal has been fully set.

The seal body 22 seals to the casing hanger with a series of annular bumps 40, 42, 44 and 46 on its ID. The casing hanger conventionally may have a shallow taper on its OD to provide energization of the seal assembly. The gaps between the series of fingers 30, 32 and 34 houses the initial low temperature puller seal 38 and the final seal 36, with the ends of the fingers optionally also providing a metal-to-metal seal between the seal body and the wellhead housing. These annulus sealing bumps are preferably provided on the seal body for reliable fluid-tight sealing with the casing hanger, or with the outer member or an inner member radially opposite the member being sealed with the final seal ring.

Radially long fingers 30, 32 and 34 contact the wellhead housing and aid in metal-to-metal sealing. Additionally, one or more of the fingers may utilize soft tips on the OD of the finger to allow the finger(s) to more easily move into defects of the wellhead housing. Similar soft tips may be provided on, or may replace the bumps 40, 42, 44 and/or 46. These soft tips may be manufactured in the form of a weld inlay prior to machining, and may cooperate with the metal seal surface of the wellhead housing or the casing hanger to reliably seal across defects. The seal assembly may include a puller section as disclosed in U.S. application Ser. No. 10/003,875 filed Oct. 31, 2001 and hereby incorporated by reference herein, which includes additional information regarding the seal assembly. In the design as shown in FIG. 2, some of the fingers are shorter and only the initial seal and the final seal contact and seal with the wellhead housing.

A variety of machined or molded solid circular ring initial puller seal elements, such as rubber, elastomeric, and/or plastic material seal elements, may be easily installed into the split seal body by stretching the seal element slightly. The initial puller seal element seals to the OD of the seal body between the fingers and to the ID of the outer member, which is the cylindrical wall forming the through bore in the wellhead housing. In a preferred embodiment, the initial seal is located below the final seal, such that the initial seal, once in sealing engagement and with fluid pressure above, exerts a pulling action on the final seal to pull the final seal toward the set position.

The characteristics of the final seal 36 which enable this element to be a reliable, durable, high temperature seal are also the characteristics which make it difficult to provide the seal material in the desired configuration between a pair of fingers, such as the fingers 30 and 32 shown in the FIG. 1. Selected materials for the final seal element include (1) a relatively soft steel, such as AISI 1005 in a soft condition, such as 96 BHN; (2) a tin or tin alloy; (3) PEEK plastic material, either virgin or glass or graphite filled; (4) teflon plastic material, either virgin or glass or graphite filled; and (5) grafhoil graphite material. According to the present invention, the sleeve shaped seal body 22 with fingers 32 and 34 thereupon may be moved upward relative to circular final seal element 36. With the element 36 supported on the annular finger 32, the seal body 20 may be lowered and threads 24 made up to reliably position the seal element 36 between the fingers 30 and 32, and as desired to also exert a selective axial compressive force on the seal element 36 to obtain a desired outer sealing surface on the seal element at the selected radial position relative to the carrier 20.

During installation, it is desirous to have the properties of the initial puller seal present to initially achieve a fluid-tight seal to the wellhead and to the OD of the casing hanger. It is customary to set the seal assembly (with the help of the running tool) by first setting weight down (to achieve an initial seal with an elastomeric seal), closing the BOP around the drill pipe and then pressuring down the choke & kill lines. This fluid pressure will cause a force to be exerted on the seal assembly and move it into place to achieve a seal. For this fluid pressure to develop the desired force, the seal assembly develops an initial seal between the casing hanger and the wall of the wellhead housing using the low temperature puller sealing element.

The improved seal assembly includes an initial puller seal, which is commonly a low temperature elastomeric seal element, to achieve an initial seal so fluid pressure exerted above the seal assembly will develop a force which causes the seal element to move into place and "set" the all-metal seal element. Once this initial seal is established, fluid pressure above the initial seal pulls the seal element down, thereby reducing the amount of mechanical force, if any, needed to be placed on top of the seal assembly. A significant portion of the setting force required to set the final seal is exerted by the initial seal pulling the final seal into place.

After an initial seal allows fluid pressure to develop a downward force, the final seal will be pressed downward by fluid pressure to achieve complete setting of the annulus seal assembly. After seal setting is complete, the initial seal is no longer required, and it is acceptable that it becomes disabled after setting is complete.

A pulling action (where the initial seal is below the metal seal) as compared with a pushing action (where the initial seal is above the final seal) is preferable. A seal assembly element which "pushes" the final seal into place and is located above the seal is also contemplated.

The initial seal preferably includes an outer lip which faces upward to help in achieving an initial seal. Furthermore, while running the tool in the well, the initial seal has an OD which is smaller than the ID of the subsea wellhead. When the casing hanger is landed and weight is set down, the ID of the initial seal is moved outward by a conventional shallow taper on the OD of the casing hanger to allow the lip on the initial seal to sealingly engage the subsea wellhead housing.

When pressure is applied from above the set seal assembly, the high temperature seal 36 supported on the finger 32 provides reliable sealing engagement with the wellhead. Finger 32, if desired, may also provide metal-to-metal sealing engagement with the wellhead. It may be assumed that the initial seal 38 is no longer functional, and finger 34 may or may not provide additional metal-to-metal sealing engagement with the wellhead. When pressure is applied from below, pressure leaks past the fingers 34, past the initial seal 38 and the middle finger 32, and again is sealed by the seal element 36, which in this case is supported on the upper finger 30, which optionally may also then may be in metal-to-metal sealing engagement with the wellhead. Seal element 36 also seals between the OD of seal body 22 and the ID of seal element 36, and thus provides a seal to prevent fluid leakage along the threads 24. In alternate embodiments, a separate seal element between the seal body 20 and the seal body 22 may be provided.

In the FIG. 2 embodiment, all the components except for the fingers may remain as disclosed in FIG. 1. Most if not all the fingers are radially "shorter" and are thus not intended for reliable sealing engagement with the wellhead 12. In some situations, the ends of the fingers may contact the wellhead, but the FIG. 2 embodiment does not rely upon any sealing engagement between the ends of the fingers and the sealing surface on the wellhead housing 12. The end of the upper finger 52 is thus spaced substantially from the sealing surface 14, as is the middle finger 54. The lower finger 56 may engage the wellhead housing, but it does not provide sealing engagement and its radial length is important only to provide proper support for the initial seal element 38. The FIG. 2 embodiment allows the outer surface of the final seal 36 to thus be spaced radially outward from an end of the fingers which support the final seal 36.

In a preferred embodiment, the high temperature seal as disclosed above may be formed from one of a group consisting of tin, a tin alloy, lead, a lead alloy, indium, an indium alloy, cast iron, plastic and one of a metal and an elastomer having a substantially lower elasticity or softer than the metal fingers. In a preferred embodiment, as shown in FIG. 2, the seal ring includes a plurality of axially spaced grooves, which each groove effectively resulting a sealing surface above and below the groove. The size of each final seal groove may be selected to concentrate applied sealing forces over a desired area, while also providing for multiple axially spaced sealing surfaces. A low temperature seal formed from a rubber or plastic material may be spaced axially between an upper metal rib and a lower metal rib, with the upper metal rib may be downwardly inclined and the lower metal rib upwardly inclined.

While the seal assembly as disclosed above is particularly well suited for sealing between a subsea wellhead as the outer member and a tubular hanger as the inner member, the seal assembly may also be used between various outer members and inner members, with one of the outer and inner members having a tapered surface for moving the seal assembly radially to a set position. One or more low temperature seals are preferably provided, and one or more of these low temperatures seals may have an initial sealing diameter for sealing between the outer member and the inner member prior to the high temperature seal ring sealing between these members. The low temperature seal preferably has an elasticity significantly greater than that of the high temperature seal ring. In a preferred embodiment, at least one of the metal fingers on the metal seal body is a continuous circumferential metal seal ring having an end for sealingly engaging one of the outer member and the inner member. In other embodiments, the low temperature seal may be eliminated, and a suitable mechanical force, such as a set down weight, may be applied to the seal assembly to move the seal assembly from an initial unset position to a final set position. In yet another embodiment, a plurality of the metal fingers may each have a sealing end. One or more of the sealing ends may be formed by a relatively soft metal inlay.

Those skilled in the art will understand that each of the metal fingers is essentially acting as an axial stop, so that one of the high temperature seal rings and/or the low temperature rings may be supported on the seal assembly by one finger above the seal ring and one finger below the seal ring. The high temperature seal ring may thus be spaced between one of the metal fingers on the metal seal body and the another finger on the another body by positioning the seal rings on one of the bodies before the selective engagement of the metal seal body and the another body. The disclosed fingers need not form a continuous seal with the outer member, e.g., the bore wall of the subsea well housing. Although a single metal seal ring and optional finger sealing end may be provided, two or more high temperature metal seal rings and one or more low temperature seal rings may also be provided on the seal assembly. The number of seal bodies will be preferably to one greater than the number of metal seal ring installed between the fingers in order to facilitate manufacture of the seal assembly. Fluid pressure may be increased above the low temperature seal to apply an initial setting force on top of the assembly seal. The low temperature seal may become disabled after setting the high temperature seal.

While preferred embodiments of the present invention have been illustrated in detail, it is apparent that other modifications and adaptations of the preferred embodiments will occur to those skilled in the art. However, it is to be expressly understood that such modifications and adaptations are within the spirit scope of the present invention, which is defined in the following claims.

What is claimed is:

1. A seal assembly for sealing between an outer member and an inner member, the seal assembly comprising:

a metal seal body including one or more radially extending stops;

another body selectively secured to the metal seal body;

a seal ring for sealing with one of the outer member and inner member and in an annular groove defined by one of the one or more stops and an end surface on the another body, such that the seal ring may be positioned axially between one of the one or more stops on the metal seal body and the another body during selective securement of the another body and the seal body; and one of the seal assembly and a tapered surface on one of the outer member and inner member being axially movable relative to the other of the seal assembly and the tapered surface for moving the seal assembly radially to a set position.

2. An assembly as defined in claim 1, wherein the seal ring comprises a seal ring formed from a group including one or more of tin, a tin alloy, lead, a lead alloy, indium, an indium alloy, cast iron, a metal softer than the metal seal body, a PEEK plastic material, a Teflon plastic material, and a grafhoil graphite material.

3. An assembly as defined in claim 1, further comprising:

an annular seal positioned on one of the metal seal body and the another body for sealing with the one of the outer member and inner member in response to fluid pressure above the seal assembly.

4. An assembly as defined in claim 3, further comprising:

the annular seal comprises a seal ring formed from a group including a rubber and an elastomeric material.

5. An assembly as defined in claim 3, further comprising:

the annular seal having an initial sealing diameter for sealing with the one of the outer member and inner member prior to sealing by the seal ring, and having an elasticity significantly greater than that of the seal ring.

6. An assembly as defined in claim 3, wherein the annular seal is positioned axially below the seal ring.

7. An assembly as defined in claim 3, wherein the annular seal is spaced axially between an upper stop and a lower stop.

8. An assembly as defined in claim 7, wherein the upper stop is downwardly inclined, and the lower stop is upwardly inclined.

9. An assembly as defined in claim 1, wherein the inner member includes the tapered surface on its outer diameter.

10. An assembly as defined in claim 1, wherein at least one of the one or more stops is a continuous circumferential metal ring having an end for sealingly engaging one of the outer member and the inner member.

11. An assembly as defined in claim 10, wherein a plurality of the stops each have a sealing end for sealing with the one of the outer member and inner member.

12. An assembly as defined in claim 1, further comprising:

one or more annular bumps on the metal seal body radially opposite the one or more stops for sealing with the other of the outer member and inner member.

13. An assembly as defined in claim 1, wherein the seal assembly is axially moved downward relative to a stationary tapered surface.

14. A seal assembly as defined in claim 1, wherein the another body is selectively securable to the metal seal body by threads.

15. A seal assembly for sealing between, a housing and a tubular hanger within the housing, the seal assembly comprising:

a metal seal body including one or more radially extending metal fingers;

the tubular hanger including a tapered surface on its radially outer surface;

another body selectively secured to the metal seal body, the another body including another radially extended finger;

a seal ring axially between one of the one or more metal fingers and the another finger for sealing with the housing, such that the seal ring may be positioned between one of the one or more metal fingers and the another finger during assembly of the seal assembly; and one of the seal assembly and the tapered surface being axially movable with respect to the other of the seal assembly and the tapered surface for moving the seal assembly radially to a set position.

16. An assembly as defined in claim 15, wherein the seal ring comprises a seal formed from a group including one or more of tin, a tin alloy, lead, a lead alloy, indium, an indium alloy, cast iron, a metal softer than the metal seal body, a PEEK plastic material, a Teflon plastic material, and a grafhoil graphite material.

17. An assembly as defined in claim 15, further comprising:

an annular seal on positioned one of the metal seal body and the another body.

18. An assembly as defined in claim 17, further comprising:

the annular seal having an initial sealing diameter for sealing with the one of the outer member and inner member prior to sealing by the seal ring, and having an elasticity significantly greater than that of the seal ring.

19. An assembly as defined in claim 17, wherein the annular seal is spaced axially between an upper metal finger and a lower metal finger.

20. An assembly as defined in claim 17, wherein the annular seal is positioned axially below the seal ring.

21. An assembly as defined in claim 15, further comprising:

one or more annular bumps on the metal seal body radially opposite the one or more metal fingers for sealing with the tubular hanger.

22. An assembly as defined in claim 15, wherein at least one of the one or more radially extending fingers is a substantially continuous circumferential ring having an end for sealingly engaging the housing.

23. An assembly as defined in claim 22, further comprising:

one or more of the metal fingers including a soft tip in the form of a weld inlay.

24. An assembly as defined in claim 15, wherein the seal ring includes one or more circumferential grooves each separating an upper seal ring sealing surface from a lower seal ring sealing surface.

25. An assembly as defined in claim 15, wherein the seal assembly is axially moved downward relative to the stationary tapered surface.

26. An assembly as defined in claim 15, wherein the housing is a subsea wellhead housing.

27. A method of forming a seal between an outer member and an inner member, comprising:

providing a seal assembly having a metal seal body including one or more radially extending metal fingers;

selectively securing another body with the metal seal body;

positioning a seal ring axially between the metal seal body and the another body during assembly of the seal assembly;

providing an annular seal axially spaced between two of the metal fingers on the metal seal body;

thereafter positioning the seal assembly between the outer member and the inner member; and moving one of the seal assembly and a tapered surface axially in response to fluid pressure above the annular seal relative to the other of the seal assembly and the tapered surface to apply a setting force to set the annular seal prior to setting the seal ring, such that the seal assembly seals between the outer member and the inner member.

28. A method as defined in claim 27, further comprising:

supporting the seal ring between one of the one or more fingers and another finger on the another body.

29. A method as defined in claim 27, wherein the annular seal is set by applying a setdown weight to the seal assembly, closing a blowout preventor around a running string, and pressurizing choke and kill lines.

30. A method as defined in claim 27, wherein the annular seal becomes disabled after setting seal ring.

31. A method as defined in claim 27, wherein the annular seal initially has a run-in diameter for sealing with a cylindrical surface on the outer member and the metal seal body engaging the inner member prior to sealing by the seal ring, and the annular member having an elasticity significantly greater than that of the seal ring; and the annular seal is moved radially to a set position by moving the seal assembly axially relative to the tapered surface on the inner member.

32. A method as defined in claim 27, further comprising:

providing one or more annular bumps on the metal seal body radially opposite the one or more metal fingers.

33. A method as defined in claim 27, wherein one or more of the metal fingers sealingly engage a wellhead housing comprising the outer member.

34. A method as defined in claim 27, wherein the seal assembly is run in a well on a running tool, and the outer member comprises a subsea wellhead housing.

35. A method as defined in claim 34, wherein the inner member comprises a tubular hanger.

36. A seal assembly for sealing between an outer member and an inner member, one of the outer member and the inner member having a tapered surface, the seal assembly comprising:

a seal body including one or more radially extending fingers;

another body selectively secured to the seal body;

a seal ring sealing with one of the outer member and inner member and in an annular groove defined by one of the one or more fingers on the seal body and an end surface on the another body, such that the seal ring may be positioned axially between the one of the one or more fingers on the seal body and the another body during assembly of the seal assembly;

one of the seal assembly and the tapered surface being axially movable relative to the other of the seal assembly and the tapered surface for moving the seal assembly radially to a set position; and an annular seal having an elasticity greater than that of the seal ring and positioned on the seal body for sealing with the one of the outer member and inner member in response to fluid pressure above the seal assembly.

37. An assembly as defined in claim 36, wherein the seal ring comprises a seal ring formed from a group including one or more of tin, a tin alloy, lead, a lead alloy, indium, an indium alloy, cast iron, a metal softer than the metal seal body, a PEEK plastic material, a Teflon plastic material, and a grafhoil graphite material.

38. An assembly as defined in claim 36, further comprising:

the annular seal is formed from a group including a rubber and an elastomeric material.

39. An assembly as defined in claim 36, wherein the annular seal is positioned axially below the seal ring.

40. An assembly as defined in claim 36, wherein the annular seal is spaced axially between an upper finger and lower finger on the seal body.

41. An assembly as defined in claim 40, wherein the upper finger is downwardly inclined, and the lower finger is upwardly inclined.

42. An assembly as defined in claim 36, wherein the inner member includes the tapered surface on its outer diameter.

43. An assembly as defined in claim 36, wherein at least one of the one or more fingers is a continuous circumferential metal ring having an end for sealingly engaging one of the outer member and the inner member.

44. An assembly as defined in claim 43, wherein the one or more fingers comprise a plurality of the fingers each have a sealing end for sealing with the one of the outer member and inner member.

45. A seal assembly as defined in claim 36, wherein the another body is selectively securable to the metal seal body by threads.

46. A seal assembly for sealing between an outer member and an inner member, the seal assembly comprising:

a seal body including one or more radially extending fingers, at least one of the fingers is a continuous circumferential ring having an end for sealing with one of the outer member and inner member;

another body selectively secured to the seal body and including an another body radially extending finger;

a seal ring sealing with one of the outer member and inner member and axially between one of the one or more fingers on the seal body and the extending finger on the another body, such that the seal ring may be positioned axially between one of the one or more fingers on the seal body and the finger on the another body during assembly of the seal assembly;

an annular seal positioned on one of the seal body and the another body for sealing with the one of the outer member and the inner member prior to sealing of the seal ring with the one of the outer member and the inner member;

one or more annular bumps on the seal body for sealing with the other of the outer member and inner member; and one of the seal assembly and a tapered surface being axially movable relative to the other of the seal assembly and the tapered surface for moving the seal assembly radially to a set position.

47. A seal assembly as defined in claim 46, wherein the annular seal has an elasticity greater than that of the seal ring and is positioned axially between an upper finger on the seal body and a lower finger on the seal body for sealing with the one of the outer member and inner member.

48. A seal assembly as defined in claim 46, wherein the inner member includes the tapered surface on its radially outer surface.

49. A seal assembly as defined in claim 46, wherein the seal assembly is axially moved downward relative to the stationary tapered surface.

50. A seal assembly as defined in claim 46, wherein the seal ring comprises a seat ring formed from a group including one or more of tin, a tin alloy, lead, a lead alloy, indium, an indium alloy, cast iron, a metal softer than the metal seal body, a PEEK plastic material, a Teflon plastic material, and a grafhoil graphite material.

51. A seal assembly for sealing between an outer member and an inner member, the seal assembly comprising:

a metal seal body including one or more radially extending fingers;

another body selectively secured to the seal body;

a metal seal ring sealing with one of the outer member and inner member and in an annular groove between one of the one or more fingers and an end surface on the another body, such that the metal seal ring may be positioned axially between the one of the one or more fingers on the metal seal body and the another body during assembly of the seal assembly; and one of the seal assembly and a tapered surface being axially movable relative to the other of the seal assembly and the tapered surface for moving the seal assembly radially to a set position.

52. A seal assembly as defined in claim 51, wherein the metal seal ring comprises a seal ring formed from a group including one or more of tin, a tin alloy, lead, a lead alloy, indium, an indium alloy, cast iron and a metal softer than the metal seal body.

53. A seal assembly as defined in claim 51, further comprising:

an annular seal having an elasticity greater than that of the seal ring and positioned on the metal seal body for sealing with the one of the outer member and inner member in response to fluid pressure above the seal assembly.

54. A seal assembly as defined in claim 53, further comprising:

the annular seal is formed from a group including a rubber and an elastomeric material.

55. A seal assembly as defined in claim 53, wherein the annular seal is spaced axially between an upper finger and lower finger on the seal body.

56. A seal assembly as defined in claim 51, further comprising:

one or more annular bumps on the metal seal body radially opposite the one or more stops for sealing with the other of the outer member and the inner member.

57. A seal assembly as defined in claim 51, wherein the seal assembly is axially moved downward relative to the stationary tapered surface.

58. A seal assembly as defined in claim 51, wherein at least one of the one or more fingers is a continuous circumferential metal ring having an end for sealingly engaging one of the outer member and the inner member.

59. A seal assembly as defined in claim 51, wherein the another body is selectively securable to the metal seal body by threads.

60. A seal assembly for sealing between an inner cylindrical surface on an outer member and an inner member including an outer tapered surface, the seal assembly comprising:

a seal body including one or more radially extending fingers;

another body selectively secured to the seal body;

a seal ring sealing with the inner cylindrical surface and spaced axially between one of the one or more fingers and the another body, such that the seal ring may be positioned axially between one of the one or more fingers on the seal body and the another body during assembly of the seal assembly;

one of the seal assembly and the tapered surface being axially movable relative to the other of the seal assembly and the tapered surface for moving the seal assembly radially to a set position; and an annular seal having an elasticity greater than that of the seal ring and positioned on one of the seal body and the another body for sealing with the inner cylindrical surface prior to sealing between the seal ring and the inner cylindrical surface.

61. An assembly as defined in claim 60, wherein the seal ring comprises a seal ring formed from a group including one or more of tin, a tin alloy, lead, a lead alloy, indium, an indium alloy, cast iron, a metal softer than the metal seal body, a PEEK plastic material, a Teflon plastic material, and a grafhoil graphite material.

62. An assembly as defined in claim 60, further comprising:

the annular seal is formed from a group including a rubber and an elastomeric material.

63. An assembly as defined in claim 60, wherein the annular seal is spaced axially between an upper finger and a lower finger on the seal body.

64. An assembly as defined in claim 60, further comprising:

one or more annular bumps on the metal seal body radially opposite the one or more stops for sealing with the inner member.

65. An assembly as defined in claim 60, wherein the seal assembly is axially moved downward relative to the stationary tapered surface.

66. An assembly as defined in claim 60, wherein at least one of the one or more fingers on the seal body is a continuous circumferential metal ring having an end for sealingly engaging one of the outer member.

* * * * *